US010492622B2

(12) United States Patent
Rhen

(10) Patent No.: US 10,492,622 B2
(45) Date of Patent: Dec. 3, 2019

(54) DIAPER CHANGING CANOPY

(71) Applicant: Jenna Danielle Rhen, Downingtown, PA (US)

(72) Inventor: Jenna Danielle Rhen, Downingtown, PA (US)

( * ) Notice: Subject to any disclaimer, the term of this patent is extended or adjusted under 35 U.S.C. 154(b) by 17 days.

(21) Appl. No.: 15/706,080

(22) Filed: Sep. 15, 2017

(65) Prior Publication Data

US 2018/0078049 A1 Mar. 22, 2018

Related U.S. Application Data

(60) Provisional application No. 62/395,585, filed on Sep. 16, 2016.

(51) Int. Cl.

| | |
|---|---|
| ***A45C 9/00*** | (2006.01) |
| ***A47D 5/00*** | (2006.01) |
| ***A45C 3/00*** | (2006.01) |
| ***A45F 3/02*** | (2006.01) |
| ***A45F 4/06*** | (2006.01) |

(52) U.S. Cl.

CPC ..... *A47D 5/006* (2013.01); *A45C 3/00* (2013.01); *A45C 9/00* (2013.01); *A45F 3/02* (2013.01); *A45F 4/06* (2013.01)

(58) Field of Classification Search

CPC ..... A47D 5/006; A45C 3/00; A45C 9/00
USPC ..... 190/2
See application file for complete search history.

(56) References Cited

U.S. PATENT DOCUMENTS

| | | | | |
|---|---|---|---|---|
| 4,796,734 A * | 1/1989 | Distasio | ..... | A45C 3/10 135/95 |
| 2008/0163430 A1* | 7/2008 | Mayes | ..... | A47D 5/006 5/655 |

* cited by examiner

*Primary Examiner* — Tri M Mai
(74) *Attorney, Agent, or Firm* — Fox Rothschild LLP

(57) ABSTRACT

A portable, collapsible canopy for use with a diaper changing pad, wherein the canopy comprises a frame structure having a plurality of rigid members adjoined by a plurality of pivotable joints, with at least one of the pivotable joints being spring-biased. The canopy further comprises a plurality of wall portions coupled to the frame structure, wherein the wall portions are formed of a lightweight, flexible material. The canopy also comprises a bottom section in which the changing pad is placed upon. The frame structure is configured to be held normally open by the spring-biased joints, and the frame structure and wall portions are manually collapsible so as to enable the canopy to be folded into a compact state suitable for storage in a diaper bag. A combination diaper bag and diaper changing canopy are also disclosed.

15 Claims, 14 Drawing Sheets

DIAPER CHANGING CANOPY

CROSS-REFERENCE TO RELATED PATENT APPLICATION

This patent application claims the priority of U.S. provisional application Ser. No. 62/395,585 filed 16 Sep. 2016 in the name of Jenna Danielle Rhen for an invention entitled "Portable Collapsible Diaper Changing Canopy"; the priority of the '585 application is claimed under 35 USC 119 and 120.

FIELD OF THE INVENTION

The present disclosure relates to infant and toddler care, and more particularly to assisting caregivers in providing privacy, convenience, and protection when changing the diaper of an infant or toddler in a public setting.

BACKGROUND OF THE INVENTION

In today's society, infant and toddler caregivers are frequently on-the-go, away from the comforts of home. Regardless of location, however, an infant or toddler's diaper must be changed soon after the child has urinated and/or defecated in order to avoid unsanitary conditions, which may possibly give rise to skin rashes or even infections. Changing a soiled diaper additionally helps relieve the child from potential discomfort from the soiled diaper.

Caregivers are often in a public locale at a time when the child's diaper must be changed, far from adequate diaper-changing facilities. In many public venues, such as airports, parks, restaurants, businesses, etc., it is at the very least embarrassing, and perhaps even socially unacceptable, for the caregiver to change the child's diaper in view of bystanders.

While diaper "changing stations" and similar accommodations are more commonplace today than ever before, there are still many instances when the caregiver may not be near a public restroom having such amenities, or the restroom to which the caregiver has access may not have a changing station. For example, many public men's and unisex restrooms still do not have changing stations available for use.

Additionally, the caregiver may simply wish to avoid using a public restroom for changing the child's diaper due to the inconvenient location of the public restroom, or due to a perceived or actual lack of cleanliness of the public facility. Furthermore, caregivers may not be comfortable changing a child's diaper in a public restroom or other facility that does not match the child's gender, such as changing a female toddler in a men's restroom, etc.

Advances in technology such as smart phones and the like, make it much easier for persons to exploit photos and infringe on privacy. Providing a diaper changing product that involves an enclosed changing area provides privacy for infants.

The primary caregiver role has changed over time. More men are becoming "hands-on" in the diaper changing process and child-caring duties overall. Men need the convenience to change their children's diapers as well as do women. Recent efforts have been made to try to establish changing stations in men's bathrooms in public buildings; one example of this is the "Babies Act" mandating changing stations in men's rooms in all federal government buildings. Also, the organization operating the "Change.org" website is reaching out to major retailers requesting that such retailers provide such changing stations in men's room at their establishments.

Accordingly, there is a need among caregivers for a convenient device facilitating privacy while changing a child's diaper "on the fly" in a public setting such as park, a shopping mall, a public swimming pool, an airport, a hotel lobby, an amusement park, an automobile parking lot, a community picnic, and the like.

IDENTIFICATION OF THE PRIOR ART

Prior art patents and patent publications known to Applicant are U.S. Pat. No. 7,389,897, U.S. Patent Publication No. 2004/0131801 A1, and U.S. Pat. No. 6,199,220.

SUMMARY OF THE INVENTION

The portable collapsible infant changing pad canopy in one of its aspects includes a portable pop-up tent-like structure for providing a convenient changing pad station for caregivers who lead an active lifestyle. The portable collapsible infant changing pad canopy of the invention easily unfolds to form a small tent or "canopy" providing privacy for the infant changing procedure. The tent or canopy springs to an erect state from a flattened state. When desired to collapse the tent or canopy back to the flattened state, three simple actions move the canopy back into a collapsed state for storage and transport.

The interior bottom of the portable collapsible infant changing pad canopy preferably contains a removable changing pad for diaper changing protection and easy cleaning. The portable collapsible infant changing pad canopy of the invention collapses into a small portable state such that the changing pad canopy can fit into most standard diaper bags.

When constructed in such size and dimensions, the changing pad canopy, when in its erect condition, accommodates both infants and toddlers. The changing pad canopy preferably is constructed of lightweight, washable, flame-retardant materials, making the changing pad canopy highly portable and presumably relatively inexpensive to manufacture. In addition, a mesh trim is included around the base of the unit to provide added ventilation and modest two-way visibility.

In one of its aspects, this invention provides a bag having attached straps for hand or shoulder carriage of the bag. The bag includes a collapsible canopy for concealing a baby during diaper change with a canopy having one end secured to the bag. The canopy when collapsed is storable within a pocket portion of the bag. The canopy includes a waterproof changing pad for supporting a baby during diaper change. The canopy further includes a tunnel-like portion, into which the changing pad (desirably folded and stored when not in use, in a sealed pocket portion of the bag) preferably having plural layers of fabric overlying one another and preferably including a collapsible spring for maintaining a tunnel-like portion in position above the changing pad during baby diaper change. The spring lies between two of the fabric layers and is secured to an inner one of the layers of fabric between which the spring is positioned. The spring is secured to the fabric preferably by sewing. The spring, when it expands, has an arch-like shape and serves to support the tunnel-like portion.

The pocket portion of the bag is closable by a flap when the canopy is within the pocket portion in the canopy collapsed disposition. The flap of the bag has a preferably curved edge releasably connecting with the remaining portion of the bag to close the pocket portion of the bag, when the flap curved edge is connected to the remainder portion of the bag with the curved edge of the flap defining a curved portion of the pocket having curvature larger than curvature of the tunnel portion of the canopy. Other configurations for the pocket such as square, rectangular, etc. are within the scope of the invention. The shape of the flat and the flap edge portion would change as different pocket shapes are employed. Desirably the spring is a coil spring and further desirably, the bag has a flat bottom and the flap has a preferably straight edge flexibly connected to an edge of the bottom of the bag.

DETAILED DESCRIPTION OF THE INVENTION

As used herein, the singular forms "a", "an", and "the" include plurals unless the context clearly indicated otherwise. Unless otherwise defined, all technical and scientific terms used herein have the meanings commonly understood by one of ordinary skill in the art. As used herein, the term "comprising" means "including, but not limited to."

Figure 4:
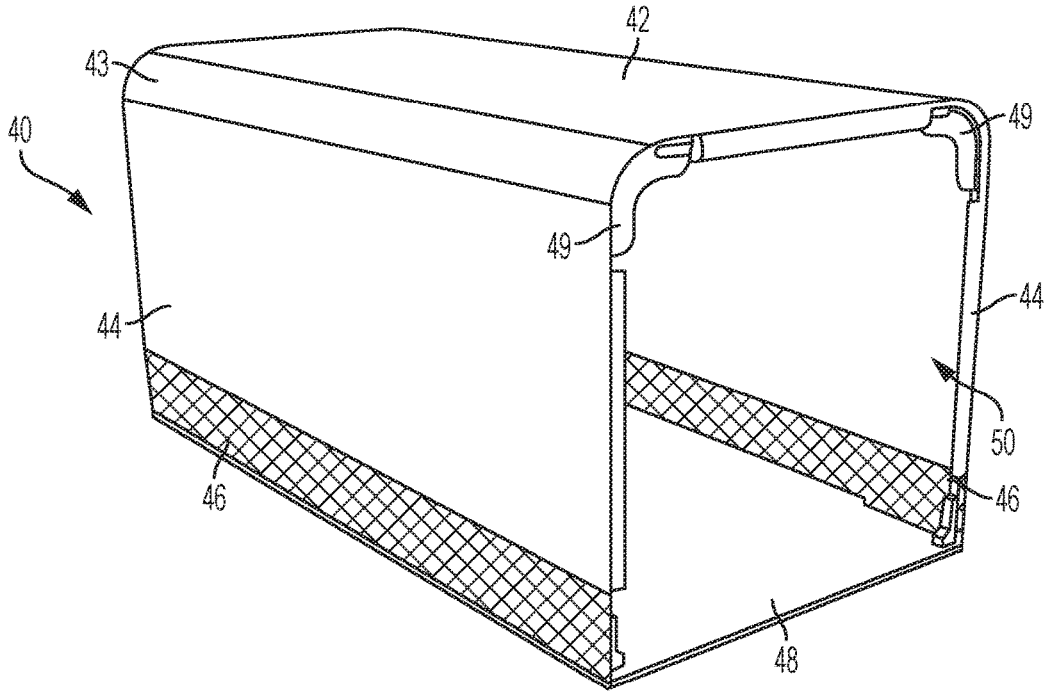
FIG. 4 is a perspective view of a portable collapsible infant changing pad canopy showing the front and right side in accordance with another aspect of the invention.
Figure 5:
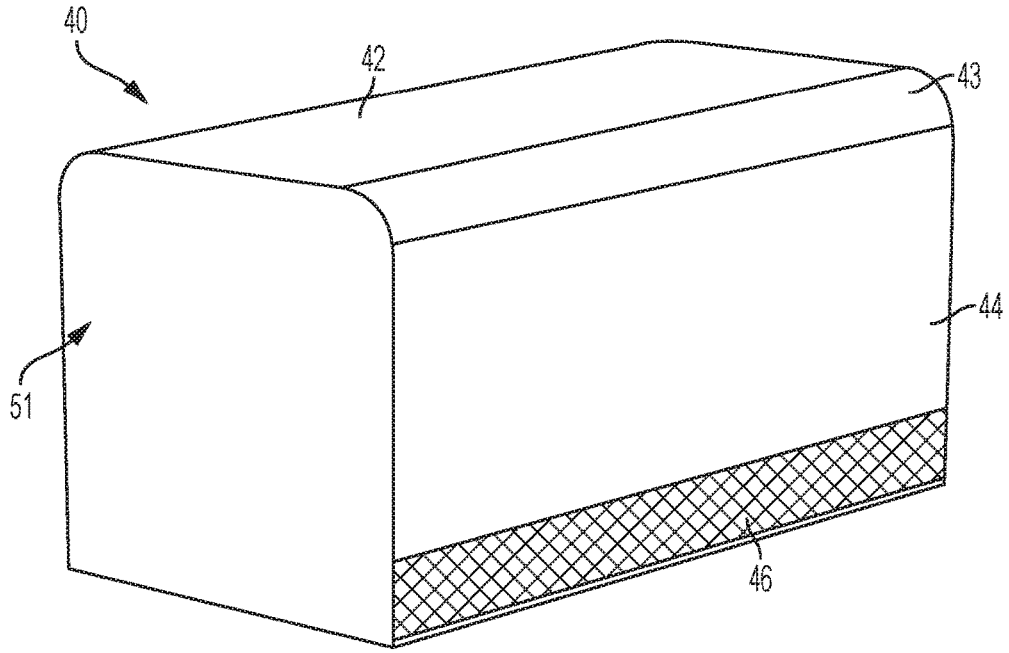
FIG. 5 is a perspective view of the portable collapsible infant changing pad canopy shown in FIG. 4 showing the back and right side.
Figure 6:
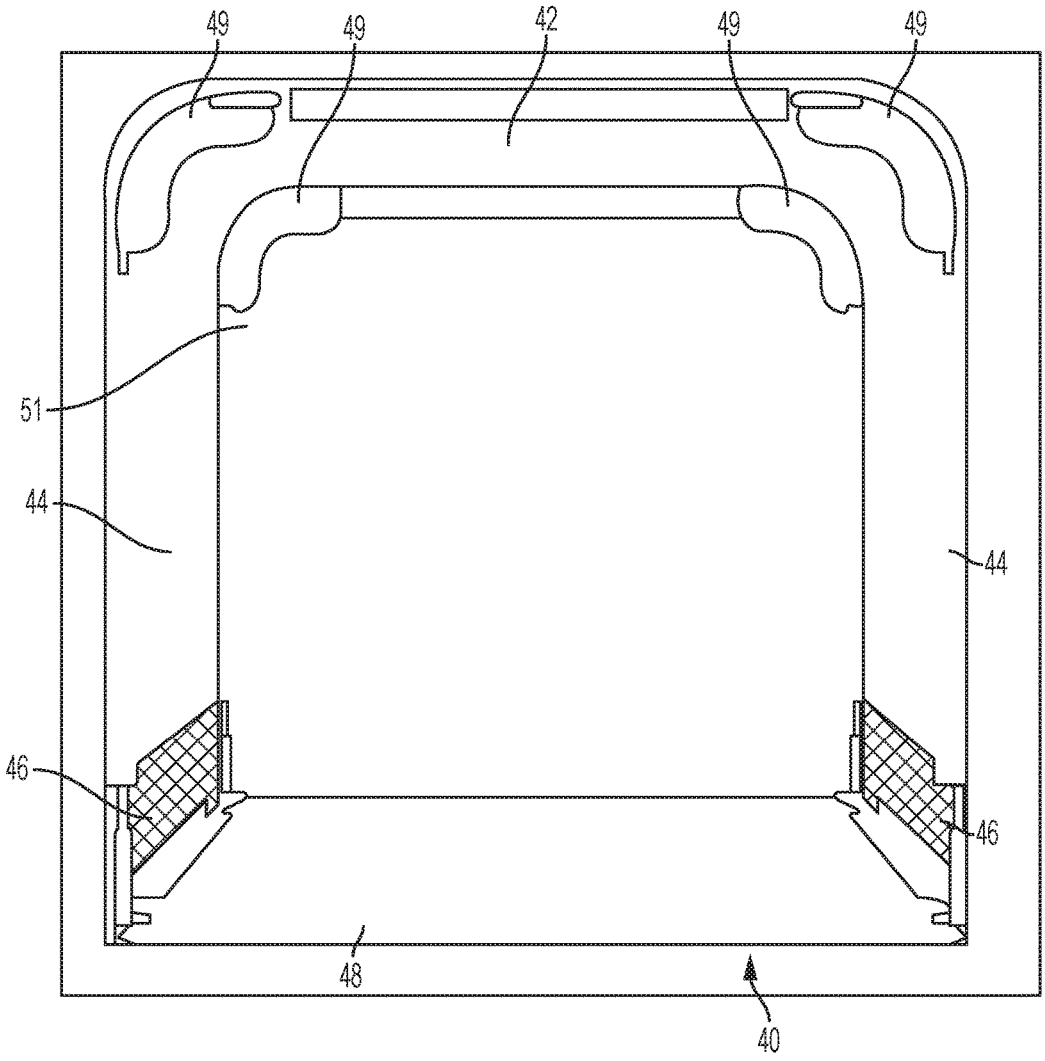
FIG. 6 is a front view in elevation of the portable collapsible infant changing pad canopy shown in FIGS. 4 and 5.
Figure 8:
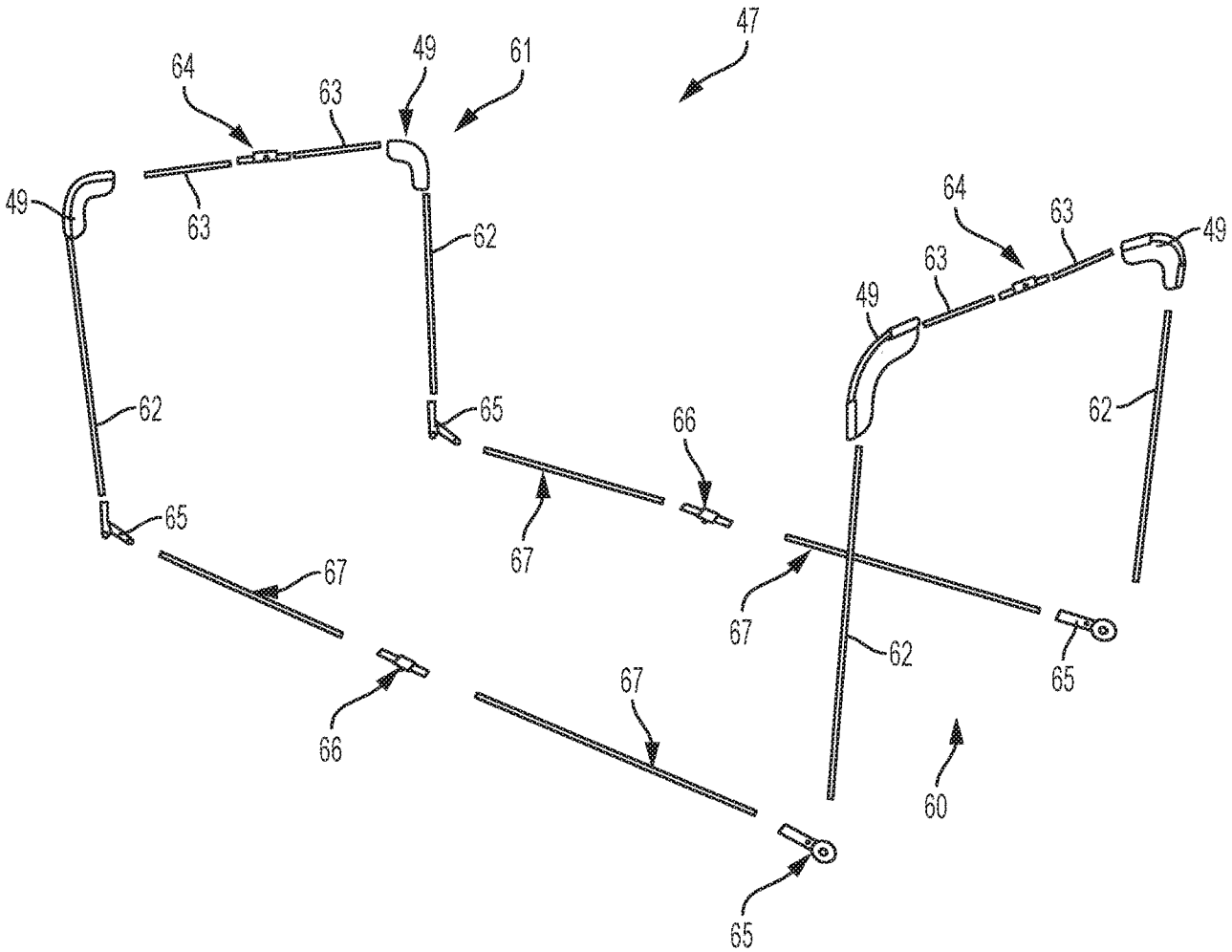
FIG. 8 is an exploded perspective view of the frame of the portable collapsible infant changing pad canopy shown in FIGS. 4 through 7.

As can be seen best in FIG. 8 and also in FIGS. 4 and 5, the invention provides in one embodiment a portable collapsible canopy for use during diaper changing where the canopy includes a manually-assembleable frame. The frame includes a plurality of linear members 62, 63, 67, a plurality of first joining members 64, 66 for manual "push together" connecting ones of the linear members 62, 63, 67 in a parallel configuration, where the first joining members are denoted 64, 66. The canopy further includes a plurality of second joining members 65 for manual "push together" connecting ones of the linear members 62, 63, 67 in perpendicular configuration with at least one of the second joining members 65 including a built in spring bias for maintaining the linear members, when joined, in perpendicular orientation respecting one another. The linear members, when joined by the respective first and second joining members define parallel parallelepiped-configured edges, as best seen in FIG. 8.

As best seen in FIGS. 4 and 5, the canopy further includes fabric for manual assembly and fitting about the parallelepiped—configured edges to define a parallelepiped shape for the canopy with at least one open end and with fabric sides and top. The canopy further includes a panel 48 fitting between linear members that are connected in parallel configuration with the panel defining the bottom of the parallelepiped shaped canopy. The canopy further includes a urine-absorbent pad supported by the panel. The linear members are less than ten inches in length, the linear members may be tubular aluminum, and the joining members are preferably plastic.

Figure 1:
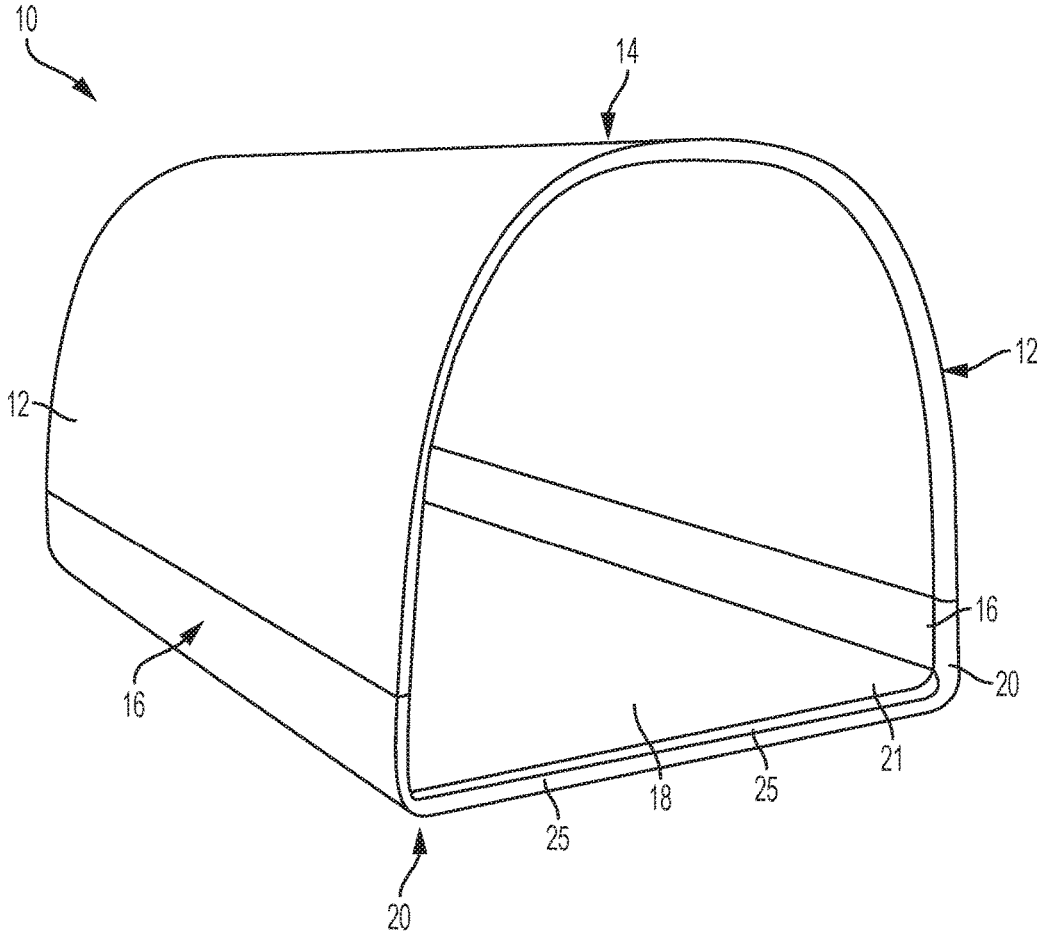
FIG. 1 is perspective of a portable collapsible infant changing pad canopy, showing the front and right side in accordance with an aspect of the invention.
Figure 2:
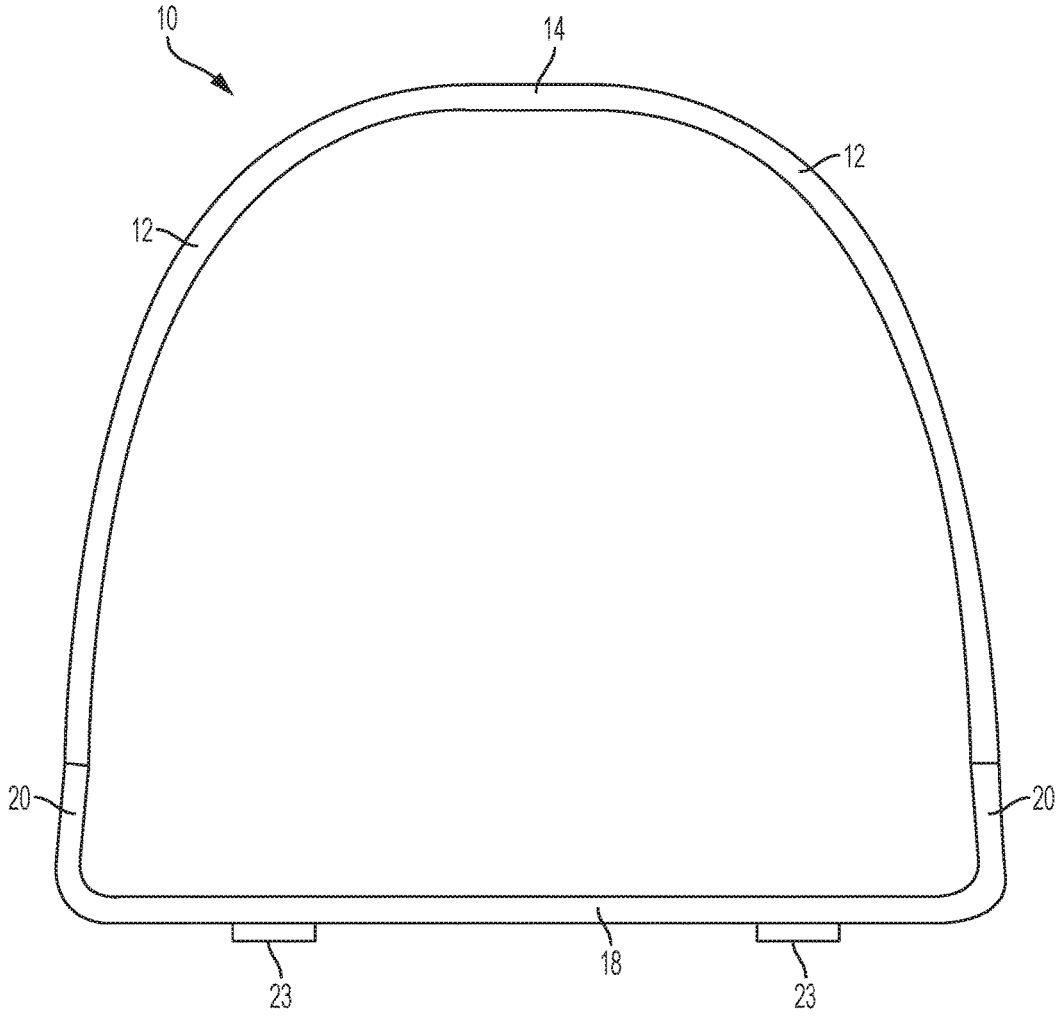
FIG. 2 is a front view in elevation of the portable collapsible infant changing pad canopy shown in FIG. 1.
Figure 3:
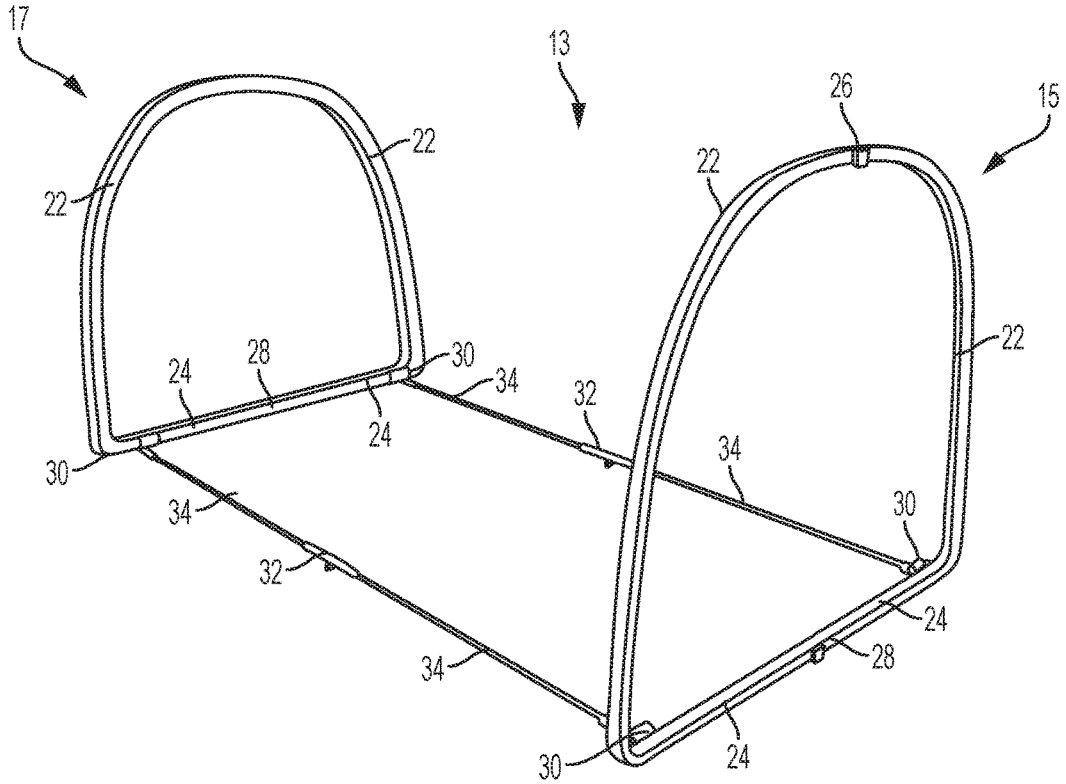
FIG. 3 is a perspective view of the structure of the portable collapsible infant changing pad canopy shown in FIGS. 1 and 2.

As best seen in FIGS. 1, 2 and 3, in one of its manifestations the canopy further includes fabric for manual assembly and fitting about tunnel-shaped edges of a manually assembled frame, illustrated in FIG. 3, to define a tunnel shape for the canopy with at least one open end and with a fabric exterior. In this manifestation the canopy further includes a panel 48 fitting between linear members that are connected in parallel configuration with the panel defining the bottom of the tunnel shaped canopy. The canopy preferably further includes a urine-absorbent pad supported by the panel.

Referring to FIG. 1 and FIG. 2, in which a portable collapsible infant changing pad canopy 10 in accordance with an aspect of the invention is shown, canopy 10 comprises a pair of curved sidewalls 12 and a curved top wall 14. Both curved sidewalls 12 and curved top wall 14 may be any appropriate, lightweight fabric or fabric-like material, such as polyester, cotton, perforated vinyl, etc. The material is preferably washable, flame-retardant, and is preferably air permeable, meaning that air can flow through the material. While both sidewalls 12 and top wall 14 are shown as being curved, it is to be understood that either or both may alternatively be substantially straight or have varying radii of curvature.

Canopy 10 further comprises a bottom section 18 preferably having respective rounded corners 20 on opposing sides thereof. Bottom section 18 may comprise an integrated or removable diaper changing pad 21 for added protection and comfort for the child. The diaper changing pad 21 may be formed of any appropriate cushioning material, such as foam, rubber, etc. Diaper changing pad 21 preferably has an absorbent upper portion so as to absorb urine, feces, water, and saliva and preferably has a liquid, e.g. urine, feces, water, and saliva, impenetrable bottom portion to prevent the flow through of urine, feces, water, and saliva while the changing pad canopy is in use. The diaper changing pad may be affixed to the bottom section 18 via any appropriate fastener(s), such as hook-and-loop Velcro-type fasteners, buttons, snaps, etc. Alternatively, the diaper changing pad 21 may be configured to lie atop bottom section 18, without the use of any means of fastening.

Canopy 10 further comprises a pair of preferably mesh upstanding sidewall portions between respective curved sidewalls 12 and a bottom section 18. Mesh sidewall portions 16 extend substantially vertically adjacent to and adjoin curved sidewalls 12, extending vertically a certain amount (e.g., about 3 inches) to provide added ventilation and limited visibility into and out of canopy 10, while still maintaining privacy within canopy 10. Mesh sidewalls 16 may extend higher or lower with respect to curved sidewalls 12, or may be omitted altogether. The "mesh" character of sidewalls 16 has not been illustrated in FIGS. 1 and 2, to endure drawing clarity.

Additional mesh portions may be present as a part of canopy 10 to provide greater ventilation and visibility for the caregiver and child. Also as shown in FIG. 2, the base of canopy 10 may optionally further include non-skid pads or sections 23 to prevent canopy 10 from sliding when placed on smooth surfaces such as floors, tables, etc. Rubber disks, or other non-slip materials may be affixed to the bottom surface of canopy 10 to prevent sliding.

Referring now to FIG. 3, a frame 13 for retaining canopy 10 in both open and closed configurations are illustrated. The members of frame 13 may be formed of any appropriate lightweight material, such as flexible plastic, polymer, wood, metal, etc. Frame 13 has a front portion 15 and a rear portion 17 configured in generally inverted "U" shape to extend vertically so as to hold canopy 10 in an open configuration when deployed. Both front portion 15 and rear portion 17 include a pair of curved rib sections, with each curved rib section comprising a curved upper portion 22 and an adjoining horizontal bottom portion 24. Respective curved upper portions 22 of adjacent curved rib sections are coupled to one another via pivot joints 26, while respective bottom portions 24 are coupled to one another via pivot joints 28. To enhance drawing clarity pivot joint 26 has been illustrated only with respect to front portion 15, not with respect to rear portion 17.

Coupling front portion 15 and rear portion 17 are a plurality of horizontal members 34. A first end of each horizontal member 34 is pivotally coupled to a respective bottom portion 24 via a pivot joint 30, while a pair of pivot joints 32 located approximately at the midpoint between front portion 15 and rear portion 17 couple second ends of horizontal members 34.

Pivot joints 26, 28 are configured to allow front portion 15 and rear portion 17 to fold along a vertical axis, while pivot joints 30, 32 are configured to allow horizontal members 34 to fold along respective horizontal axes. Such an arrangement allows for canopy 10 to be folded into an undeployed configuration thereby allowing canopy 10 to be easily stowed when not in use. However, at least one of joints 30 is preferably biased by a spring or similar internal structure to gently urge front portion 15, rear portion 17, and horizontal members 34 into a normally open, unfolded position, thereby holding canopy 10 in a deployed configuration when desired. Furthermore, while pivot joints 26, 28, 32 may be unbiased, they, like at least one of joints 30, may be spring-biased so as to aid in urging canopy 10 to deploy.

Canopy 10, when in an open, deployed configuration, is sized to provide adequate privacy and protection for children of various ages during diaper changes and the like. In one preferable embodiment, canopy 10 may be 32 inches deep, 18 inches wide, and 16 inches tall when deployed. These dimensions may vary. Preferably, canopy 10 is sized such that at least a majority of an infant's body fits therein when the infant is laid on bottom section 18 in a head-first manner. A toddler's body, on the other hand, may fit only from the waist up, depending on the child's height. In either instance, canopy 10 provides both privacy and protection for the child as the caretaker changes the soiled diaper. Furthermore, canopy 10 provides a visual and physical barrier between the child and the surrounding environment, reducing the potential embarrassment felt by the caregiver and others nearby. When the caregiver has completed changing the child's diaper, canopy 10 may be easily folded into a compact, undeployed configuration for storage in a conventional diaper bag or similar compartment, for example beneath a stroller.

Referring to FIGS. 4 through 7, a canopy 40 in accordance with an alternative aspect of the invention is illustrated. Canopy 40 comprises a top surface 42, a pair of side surfaces 44, and a bottom surface 48. A pair of rounded corners 43 couple top surface 42 to the pair of side surfaces 44. Extending between the pair of side surfaces 44 and bottom surface 48 is a respective pair of mesh portions 46. Mesh portions 46 provide improved ventilation and visibility into and out of the canopy 40. Mesh sidewalls 46 may extend higher or lower with respect to sidewalls 44, or may be omitted altogether. Furthermore, additional mesh portions may be present in canopy 40, providing improved ventilation and visibility for the caregiver and the child.

Canopy 40 desirably comprises an open front end 50 and a closed rear end 51. Open front end 50 provides access for the caregiver to place the child at least partially within canopy 40, while closed rear end 51 provides additional privacy and protection for the child. Rear end 51 may alternatively be open, similarly to front end 50.

Top surface 42, the pair of side surfaces 44, and a bottom surface 48 of canopy 40 may be formed of any appropriate, lightweight, air-permeable material, such as polyester, cotton, perforated vinyl, etc., and may be formed of different materials as a composite. The material (or materials) is also preferably washable and flame-retardant, and is preferably removable from the frame structure. Bottom surface 48 may further comprise an integrated or removable diaper changing pad 54 for added protection and comfort for the child. The diaper changing pad 54, best shown in FIG. 7, may be formed of any appropriate cushioning material, such as foam, rubber, etc., and may be affixed to the bottom surface 48 via any appropriate fastener(s), such as hook-and-loop fasteners, buttons, snaps, etc., as shown schematically as 25 in FIG. 1. Alternatively, diaper changing pad 54 may be configured to lie atop bottom surface 48 without any means of fastening. Additionally, the base of canopy 40 may further include non-skid pads or sections, such as shown schematically as 23 in FIG. 2, to prevent canopy 40 from sliding when placed on smooth surfaces such as floors, tables, etc.

Figure 7:
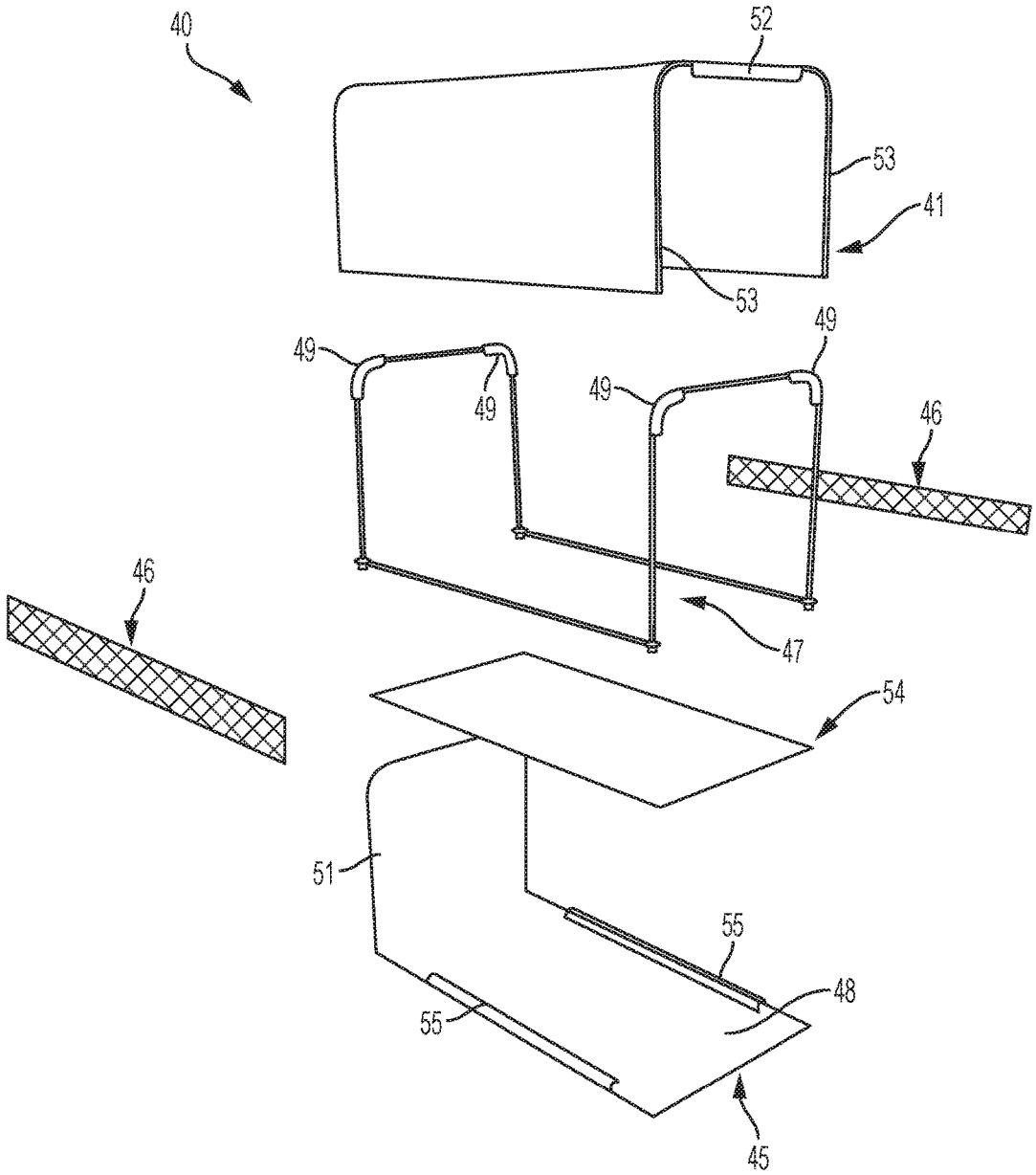
FIG. 7 is an exploded isometric view of the portable collapsible infant changing pad canopy shown in FIGS. 4, 5, and 6.

As shown in FIG. 7, canopy 40 includes a frame structure 47 which provides structural support for both a top canopy portion 41 and a bottom canopy portion 45. Frame structure 47 comprises a plurality of corner brackets 49 which provide rounded, reinforced corners adjoining the top canopy portion 41.

Referring still to FIG. 7, a plurality of connection surfaces for coupling the various portions of canopy 40 to frame structure 47 are shown. Specifically, top canopy portion 41 includes at least one horizontal connection surface 52 for connection to a corresponding horizontal member of frame structure 47, along with at least two vertical connection surfaces 53 for connection to corresponding vertical members of frame structure 47. The bottom canopy portion 45 also comprises at least two horizontal connection surfaces 55 for connection to other corresponding horizontal frame members of frame structure 47. These connection surfaces preferably hold the flexible material, which makes up at least a portion of canopy 40, securely to frame structure 47 while still allowing the flexible material of canopy 40 to be removed for washing, replacement, etc. The length, location, and type of connection surface may vary, and may utilize any suitable means, such as Velcro brand hook and eye structure, Stickum brand adhesive and the like, for securing.

Figure 9:
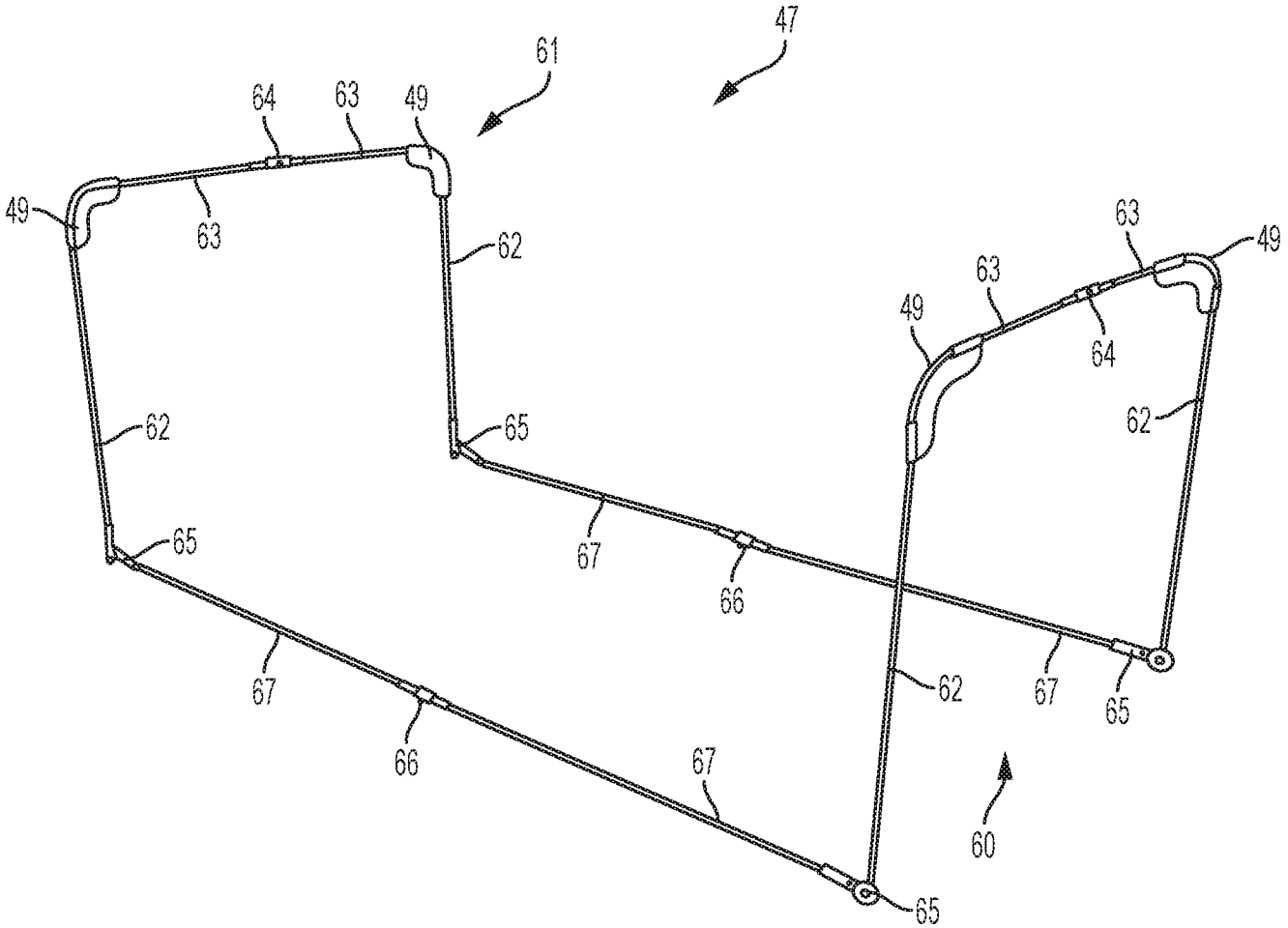
FIG. 9 is an isometric view of the frame of the portable collapsible infant changing pad canopy shown in FIGS. 4 through 8.
Figure 10:
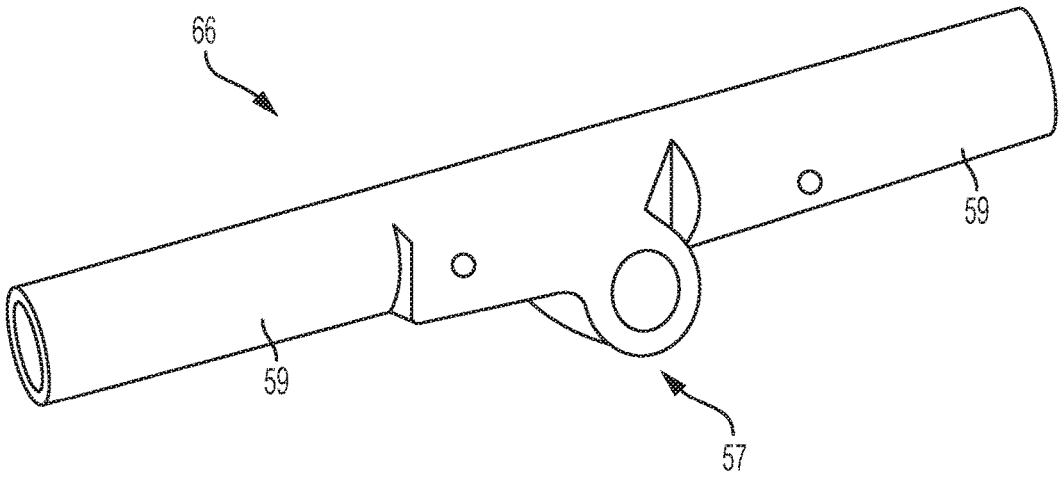
FIG. 10 is a perspective view of a joint mechanism portion of the frame of the portable collapsible infant changing pad canopy in accordance with an aspect of the invention with the joint mechanisms shown adjusted into a 180° configuration.

Referring to FIGS. 8 and 9, components of frame structure 47 of canopy 40 are illustrated. Frame structure 47 comprises a front portion 60 and a rear portion 61 configured to extend vertically so as to hold canopy 40 in an open configuration when deployed. Both front portion 60 and rear portion 61 comprise a plurality of vertical members 62 and horizontal members 63. A first end of each horizontal member 63 is coupled to a first end of a respective corner bracket 49, while a second end of each horizontal member 63 is coupled to a pivot joint 64. Likewise, a first end of each vertical member 62 is coupled to a second end of a respective corner bracket 49, while a second end of each vertical member 62 is coupled to a first end of a pivot joint 65, wherein at least one pivot joint 65 is spring-biased. In this way, the front portion 60 and rear portion 61 provide solid structural support for the canopy 40 when in a deployed position, but are still foldable so as to reduce the footprint of the canopy 40 when undeployed.

Connecting front portion 60 and rear portion 61 are a plurality of horizontal members 67. A first end each horizontal member 67 is pivotally coupled to respective vertical members 62 via a second end of pivot joint 65, while a pair of pivot joints 66 located approximately at the midpoint of the distance between front portion 60 and rear portion 61 couples second ends of horizontal members 67.

Pivot joints 64 are configured to allow front portion 60 and rear portion 61 to be folded along a vertical axis, while pivotable joints 65, 66 are configured to allow horizontal members 67 to be folded along respective horizontal axes. This arrangement allows for canopy 40 to be put into a folded, or undeployed, configuration thereby allowing canopy 40 to be compactly stowed when not in use. However, at least one of spring-biased joints 65 is biased to urge front portion 60 and rear portion 61 into an open, unfolded position, thereby holding canopy 40 in a deployed configuration.

Figure 11:
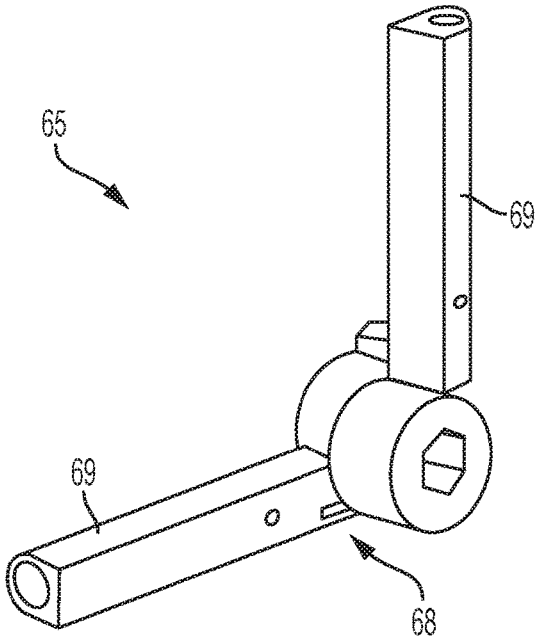
FIG. 11 is a perspective view of the joint mechanism illustrated in FIG. 10 with the joint mechanism adjusted into a 90° configuration.

For example, as FIG. 11 shows, joint 65 is biased by a spring (not visible in the drawing) located within a joint 68 in a 90° configuration such that any horizontal or vertical members coupled to connectors 69 are also biased into a 90° configuration. In this way, spring-biased joint(s) 65 acts to bias frame 47 (and thus canopy 40) into a deployed configuration such that the caregiver need do very little in order for canopy 40 to open into its usable state. While pivot joints 64, 66 are not necessarily biased by a spring or other mechanism, it is to be understood that they, too, may be biased so as to aid in opening frame 47 into a deployed configuration.

The frame parts such as the rod-like members 62, 67, pivot joint 64, 66, corner brackets 49, 65, etc., illustrated in FIGS. 8 and 9 are readily available as "Tinker Toys" or under other brands at mass marketers such as Amazon, Walmart, and Target. The other parts and materials used in fabricating the inventive changing canopy are available at Ace Hardware, Lowes, and Home Depot.

Figure 12:
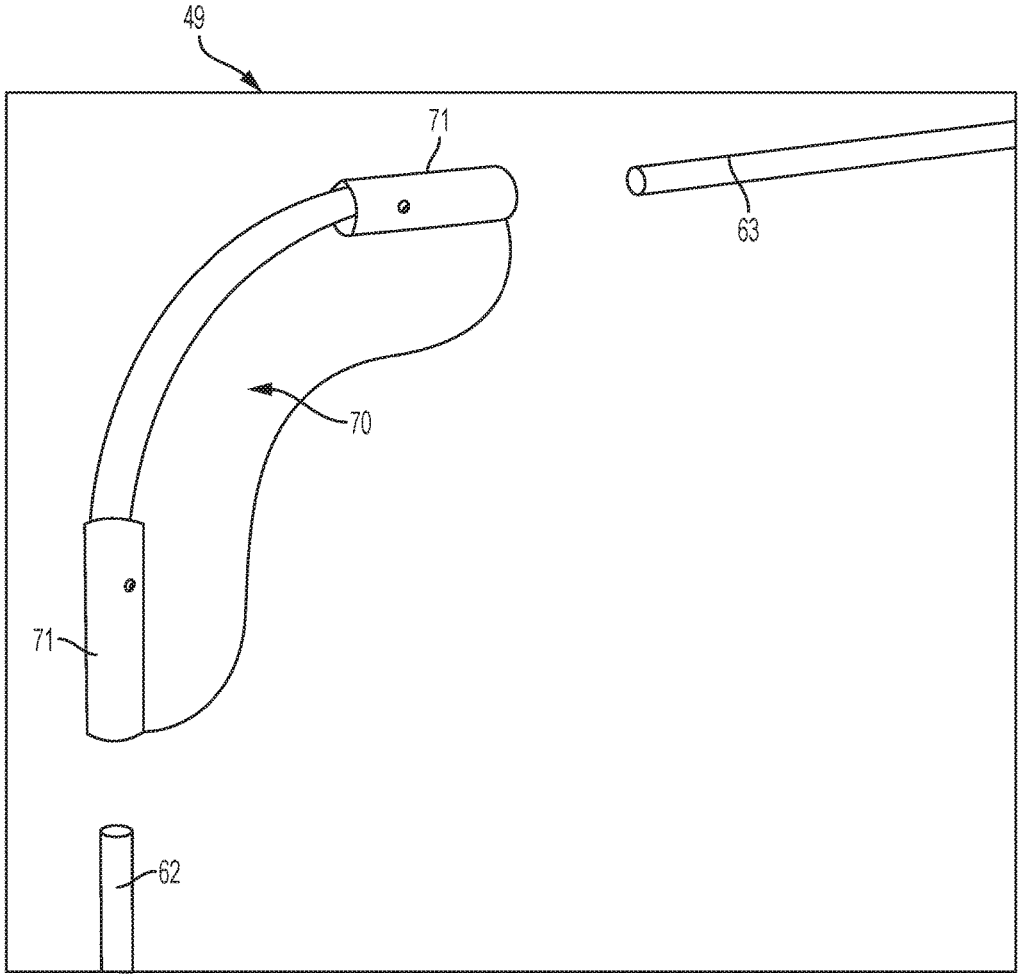
FIG. 12 is a perspective view of a corner bracket portion of the portable collapsible infant changing pad canopy in accordance with an aspect of the invention.

Referring to FIG. 12, a more detailed view of a corner bracket 49 is shown. As described above, corner bracket 49 provides rounded top corners to the top canopy portion 41 of canopy 40. Corner bracket 49 may comprise a pair of connectors 71 for coupling to horizontal members 63 and vertical members 62, respectively. Corner bracket 49 may also comprise a reinforcement portion 70 which adds additional structural integrity to the overall frame. Corner bracket 49 may be formed of any suitable lightweight material, such as plastic.

Figure 13:
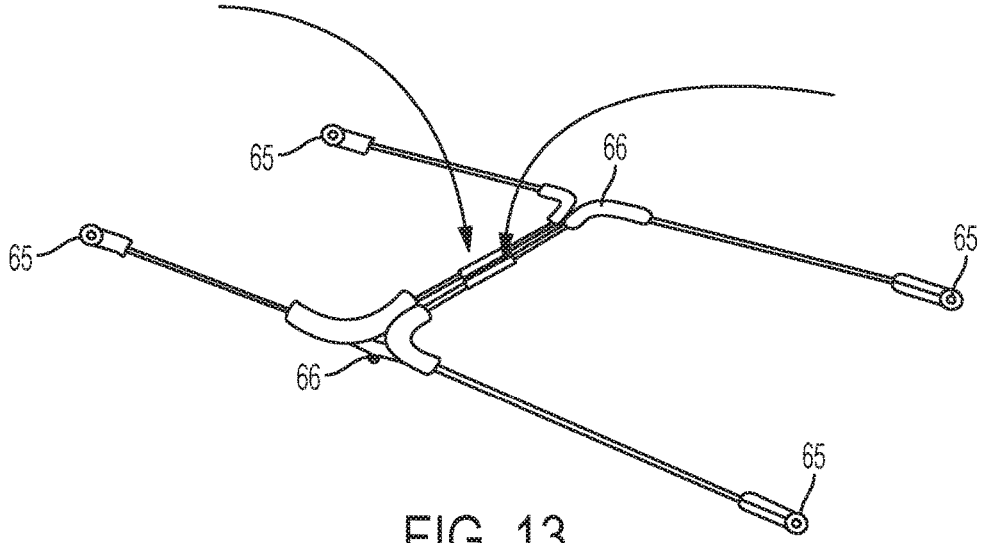
FIG. 13 is a perspective view of the frame of the portable collapsible infant changing pad canopy illustrated in FIGS. 4 through 7, shown in a first collapsed configuration.
Figure 14:
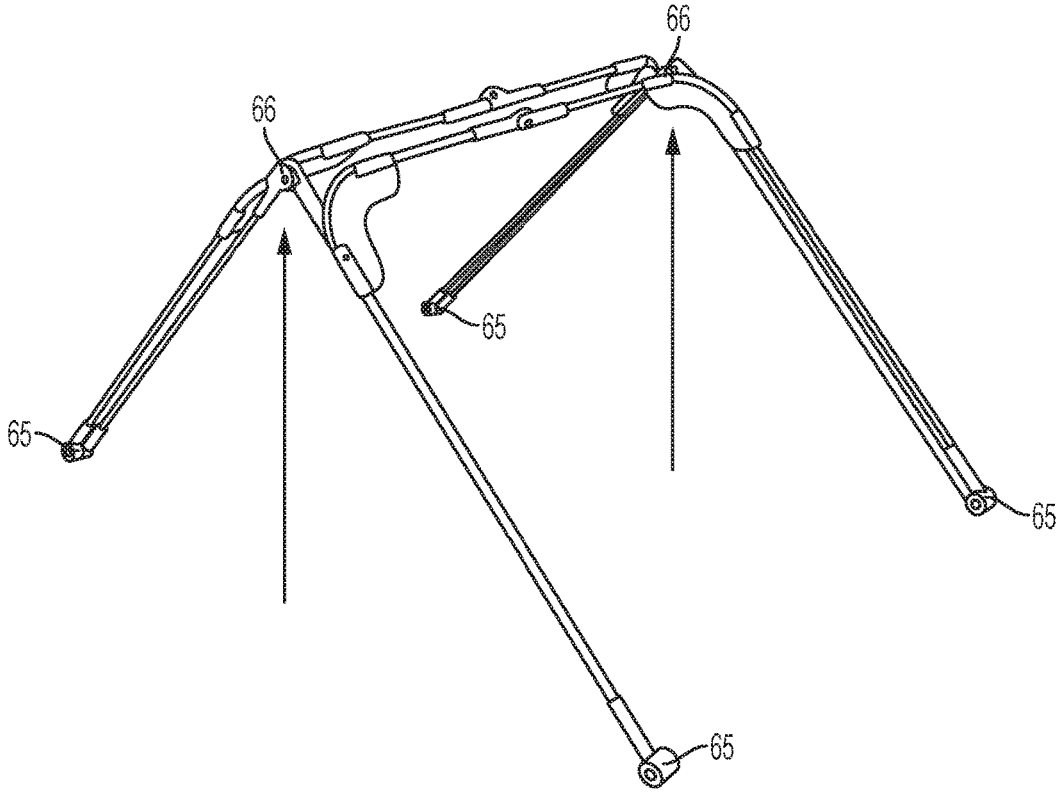
FIG. 14 is a perspective view of the frame of the portable collapsible infant changing pad canopy illustrated in FIGS. 4 through 7 shown in a second collapsed configuration.
Figure 15:
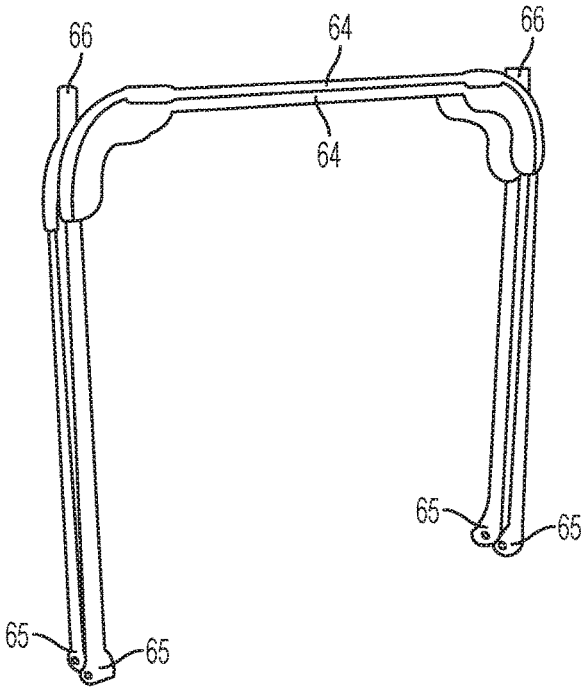
FIG. 15 is a perspective view of the frame of the portable collapsible infant changing pad canopy illustrated in FIGS. 4 through 7 shown in a third collapsed configuration.
Figure 16:
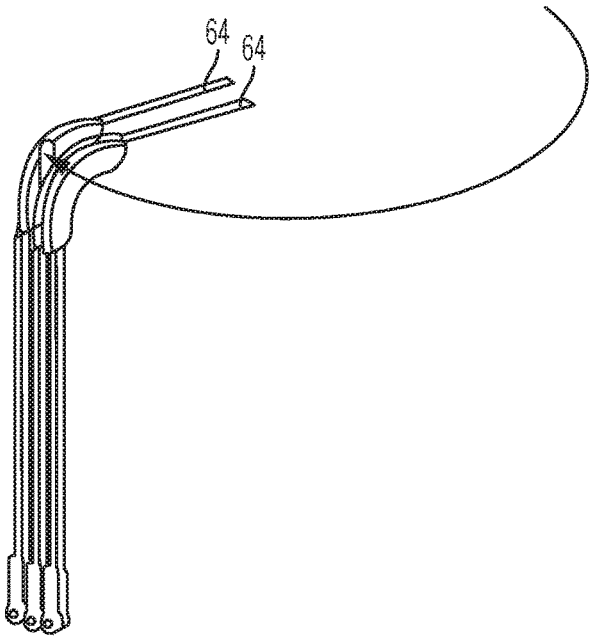
FIG. 16 is a perspective view of the frame of the portable collapsible infant changing pad canopy illustrated in FIGS. 4 through 7 shown in a fourth collapsed configuration.

FIGS. 13 through 17 illustrate the steps for frame structure 47 to be folded from a deployed state to a fully undeployed, stowable state. As shown in FIG. 13, the respective front portion 60 and a rear portion 61 are first folded inwardly along joints 65 so as to lie substantially parallel to one another. The offset pivot points of joints 65 enable adjacent members to lie substantially side-by-side in such a collapsed state, as opposed to stacked atop one another, thereby allowing the frame structure 47 to be further nested and be highly compact. Next, as shown in FIG. 14, the respective portions are folded about joint 66 until they reach a substantially flat, folded state, as illustrated in FIG. 15. Finally, the members are folded along the vertical axis about joints 64, as shown in FIG. 16. In this way, when undeployed, the entire frame structure 47 is reduced to a very compact shape that is conducive to storage in a diaper bag or other suitable compartment.

The changing pad canopy in the embodiments illustrated in FIGS. 1 through 17 essentially automatically self-springs into an erect state so as to easily unfold for caregivers. This function is specifically attractive for parents who may be holding an infant and need as few steps as possible in order to use the changing pad canopy.

The embodiments illustrated in FIGS. 1 through 17 in the collapsed state are preferably sized and designed to fit into most standard sized diaper bags. This lessens the number of products a caregiver has to carry in the diaper bag. The interior bottom of the canopy as illustrated in FIGS. 1 through 17 supports and preferably includes a desirably removable changing pad. The preferable changing pad is secured to the bottom of the canopy by a Velcro hook and loop structure or the like. The changing pad is needed to provide protection from urine or feces. By the changing pad being removable, this allows easy washing and cleaning of the changing pad.

The mesh illustrated along the base of the canopy in FIGS. 4 and 5 is preferably about three and one-half inches in height from the base of the canopy, extending upward, providing added ventilation to the infant. The mesh also provides additional safety should the infant's face come in direct contact with the side of the canopy. The canopy in the embodiments illustrated in FIGS. 1 through 17 may be stored inside a zipper and/or bottom-closing pouch that includes a padded liner on one side to double as a kneeling pad if the caregiver requires the same. In addition to zippers or buttons, other types of closures for the pouch, such as Velcro, may also be used.

Figure 17:
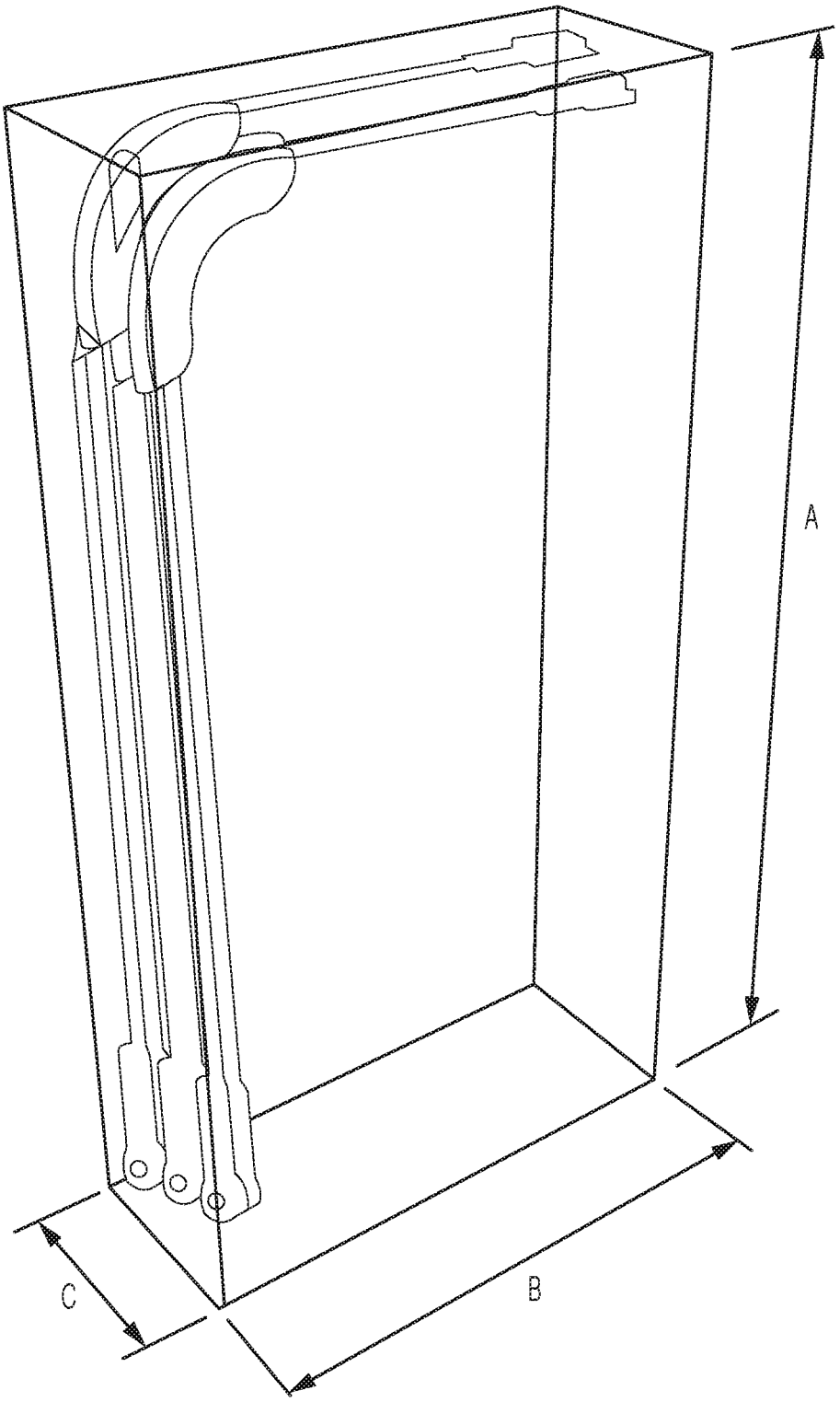
FIG. 17 is a perspective view of the portable collapsible infant changing pad canopy illustrated in FIGS. 4 through 7 shown in a collapsed configuration.

In one preferable embodiment of the invention, as shown in FIG. 17, the overall footprint of folded frame structure 47 may be about 16 inches high as indicated by dimension "A", about 8 inches long as indicated by dimension "B", and about 3 inches wide as indicated by dimension "C", allowing frame structure 47 to easily fit within many conventional bags. However, larger or smaller dimensions of folded frame structure 47 are also within the scope of the invention.

Also, while not shown in FIGS. 13 through 17, it is to be understood that the material portions (such as the preferably polyester canopy) surrounding frame structure 47 are designed to remain on the frame during deployment and during knock-down to the collapsed state. The flexible material portions 42, 43, 44, etc., may be removed from frame structure 47 after deployment for cleaning and the like. Furthermore, diaper changing pad 54 may remain within canopy 40 in both the open, deployed configuration and the closed, "collapsed" configuration, or may be removed prior to folding of frame structure 47.

Figure 18:
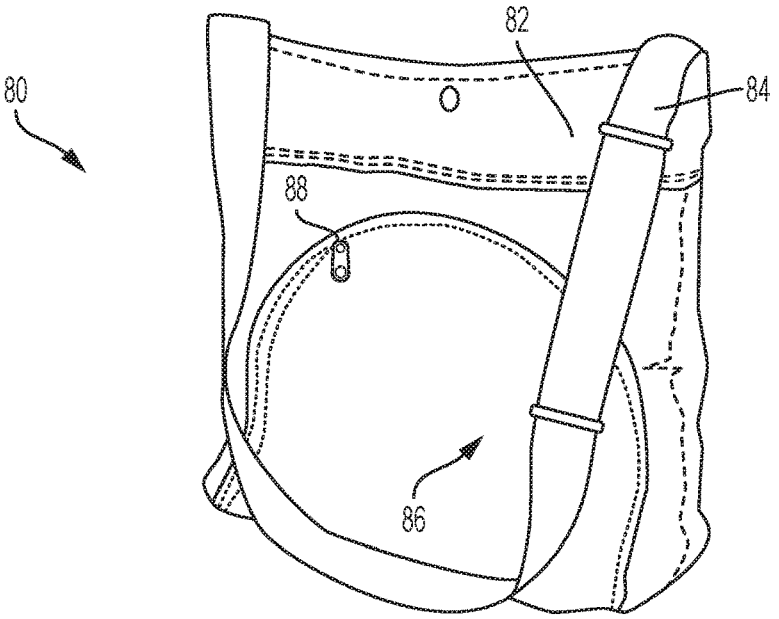
FIG. 18 is a perspective view of a diaper bag/backpack having a collapsible infant changing pad canopy as a part thereof in accordance with another aspect of the invention.
Figure 19:
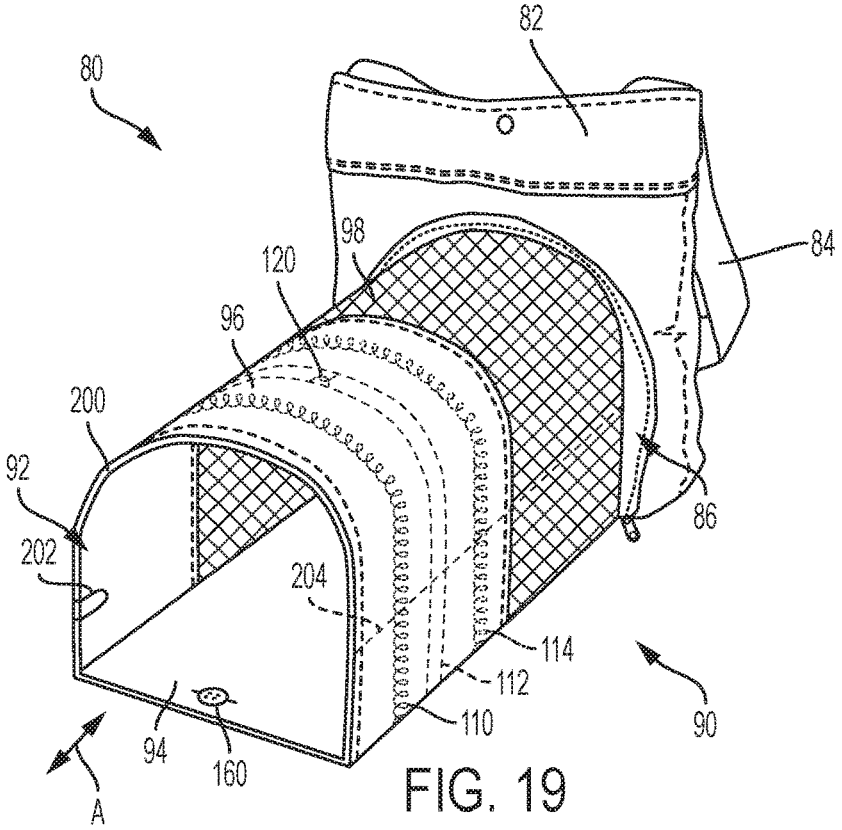
FIG. 19 is a perspective view of the diaper bag/backpack of FIG. 18 having an infant changing pad canopy extending therefrom in an "open" configuration.

FIGS. 18 and 19 illustrate a combined diaper bag/backpack collapsible infant changing pad canopy 80 in accordance with another aspect of the invention. Combination 80 comprises a diaper bag 82 having a strap 84 affixed thereto. Strap 84 may be an over-the-shoulder strap, a cross-body strap, a hand strap, or any other suitable handle or attachment device and combination 80 may be configured as a backpack with strap 84 going over the user's shoulder. On one side of diaper bag 82 is a canopy storage pocket 86 having a closure mechanism 88. Closure mechanism 88 may be any suitable closure mechanism, such as a zipper, snaps, buttons, hook-and-loop closures, etc.

The collapsible infant changing pad canopy 80 portion of the combined diaper bag/backpack preferably adheres and most preferable is secured to the side of the diaper bag to provide a convenient pull-out changing station. The dimensions of the combined diaper bag/backpack collapsible infant changing pad canopy 80 in the expanded state are designed to accommodate infants on up to toddlers based on the torso and height of the infant or toddler. While the combined diaper bag/backpack collapsible infant changing pad canopy 80 can accommodate toddlers, the main use will be that for infants since infants are less mobile than toddlers when requiring a change of diapers.

The backside of the combined diaper bag/backpack collapsible infant changing pad canopy 80 has a side pocket, not shown in the drawings, to enhance drawing clarity, to store the changing pad. The user can simply remove the changing pad from the pocket and place the pad beneath the canopy for protection of the infant during the diaper change procedure. The changing pad is needed to provide protection from urine or feces. Since the changing pad is removable from the canopy when the canopy is in its expanded operable position, the changing pad is easily washed and cleaned.

Desirably, as illustrated in the drawing, there is breathable mesh included along a portion of the length of the base of the canopy for added ventilation for the infant. The mesh not only provides ventilation, but serves to keep the product weight down thereby making the product highly portable, wipe able, washable, and flame retardant, all of which are important aspects when giving caregivers a product for a presumably desirable diaper changing experience.

As shown in FIG. 19, when canopy storage pocket 86 is opened via closure mechanism 88, a collapsible canopy 90 that is partially integrated with the diaper bag 82 is deployed from the canopy storage pocket 86 so as to form a private space in which a caregiver may change the diaper of an infant or toddler. The collapsible canopy 90 has a preferably open first end 92 into which a child may be placed head-first, a changing pad 94 on an unnumbered base portion, a first material portion 96, and a second material portion 98 which is preferably mesh, as illustrated. A second end of the collapsible canopy 90 is affixed to the bag 82 within canopy storage pocket 86, thereby creating a closed second end of canopy 90 a tunnel shaped semi-rigid rib 200 defines the open first end 92 of collapsible canopy 90 and helps maintain the canopy in a tunnel-like shape.

Canopy first material portion 96 is preferably made of a flexible, opaque, washable, lightweight, non-flammable material such as polyester so as to provide coverage for the lower half of the child's body, while second material portion 98 may preferably be a mesh or similar material to provide added ventilation and modest visibility for both the child and the caregiver. It is to be understood first material portion 96 and second material portion 98 may also optionally be the same material. Most desirably both first and second material portions 96 and 98 are multiple layers of fabric, with the layer or effectively a sheet of fabric layers lying over each other in facing disposition.

The placement of the mesh or similar material may also vary. For example, second mesh material 98 may only be located along a bottom trim portion of canopy 90, similar to that shown in FIG. 1 and FIG. 4. Furthermore, changing pad 94 is desirably removable for cleaning and/or storage. Bag 82 may further comprise a storage pocket (not shown) which may house changing pad 94 during non-use of the canopy 90.

Most desirably, canopy 90 and particularly first and second material portions 96, 98 are fabricated with some elastic threads being present therein to provide stretchability and return properties when stretched. This allows the collapsible canopy 90 to elastically contract and return to its folded position once the diaper change procedure has been completed. Moreover, the presence of elastic threads in first and second material portions 96, 98 also provides a degree of resistance when the caregiver seeks to open collapsible canopy 90. The slight degree of resistance to opening, which is easily manually overcome, facilitates single-handed operation and opening of the canopy 90. A clip 202, which may be as simple as a paper clip or binder clip, can be used to maintain canopy 90 in the open position if first and second material portions 96, 98 are elastic in nature, by securing front fabric portion 96 to rib 200. Simply releasing the clip 202 allows canopy 90 to retract and collapse without further interference or operation by the caregiver.

When a caregiver wishes to use collapsible canopy 90, the user simply opens canopy storage pocket 86, deploys the canopy 90, and, if separate from rest of canopy 90, places the changing pad on a bottom portion of canopy 90. The canopy 90 may be held open by any appropriate structure, such as a plurality of plastic arched ribs such as rib 200.

Collapsible canopy 90 further preferably includes a bottom surface similar to surface 48 as described above with respect to the embodiment of the changing canopy illustrated in FIG. 1. Bottom surface 41 is provided to support a desirably removable diaper changing pad 94 providing added protection and comfort for the child. Alternatively and preferably, a resilient spring structure, which may be of coil, spiral or hoop configuration, may be disposed within either or both of the respective first and second material portions 96, 98 such that the canopy 90 may self-deploy due to the resilient action of the spring structure, preferably in conjunction with the elastic threat 204 optionally included in material parts 96, 98. Suitable spring structures are shown schematically in FIG. 19, with the coil structure denoted 110, the spiral structure denoted 112, and the hoop structure denoted 114 and shown in dotted, dashed, and dot/dash lines respectively.

Both first and second material portions 96, 98 are preferably two layers of fabric or other flexible material, with the spring structure resident between the layers and secured to the layers by several sewn loops positioned slidably and loosely around the spring structure while being secured to the fabric cloth. Most desirably the loops are secured to the inner layer of fabric to prevent sagging when the canopy is deployed. One such loop 120 is depicted schematically in FIG. 19.

When finished utilizing the canopy 90, the caregiver need only remove the changing pad 94 (if separate), press the canopy 90 into the canopy storage pocket 86, and close the canopy storage pocket 86 using closure mechanism 88. In this way, the combined diaper bag/collapsible infant changing pad canopy 80 shown and described with respect to FIGS. 18 and 19 provides the child and caregiver with both privacy and protection during a diaper change, particularly in instances where private, sanitary changing facilities are not available or are inconveniently located.

The features and functions described above, as well as alternatives, may be combined into many other different systems or applications. Various alternatives, modifications, variations, or improvements may be made by those skilled in the art, each of which is also intended to be encompassed by the disclosed embodiments.

From the foregoing description of the exemplary embodiments of the invention, it will be readily apparent to those skilled in the art to which the invention pertains that the principles and particularly the structures disclosed herein and the methods of use thereof can be used for applications other than those specifically mentioned.

The invention may be embodied in other specific forms without departing from the spirit or essential characteristics of the invention. The disclosed embodiments are therefore to be considered in all respects as illustrative and not restrictive with the scope of the invention being indicated by the appended claims rather than by the foregoing description. All changes which come within the meaning and the appropriate and lawful range of equivalency of the claims are embraced therein.

As used in the claims herein, the term "comprising" means "including," while the term "consisting of" means "including so much and no more," and the term "consisting essentially of" means including the recited elements and those minor accessories required and known to be used in the art to facilitate the invention as claimed. The scope of the invention is, therefore, indicated by the appended claims and all changes which come within the range of equivalency of the claims are to be considered to be embraced within their scope.

The invention claimed is:

1. A bag comprising:

a. a collapsible canopy for concealing a baby during diaper change, the canopy having one end secured to the bag, the canopy when collapsed being storable within a pocket portion of the bag, the canopy comprising:

i. a waterproof changing pad for supporting a baby during diaper change;

ii. a tunnel portion overlying the changing pad and comprising fabric; and iii. a collapsible spring for maintaining the tunnel portion in position above the changing pad during baby diaper change; the spring lying being under the fabric and being secured to the fabric by sewing, the spring when expanded having an arch-like shape; and b. a pocket portion of the bag being closeable by a flap when the canopy is within the pocket portion.

2. The bag of claim 1 further comprising flap having an edge releasably connected with a remaining portion of the bag to close the pocket portion of the bag when the flap edge is connected to the remaining portion of the bag.

3. The bag of claim 1 wherein the spring is a coil spring.

4. The bag of claim 2 wherein the bag has a flat bottom and the flap has straight edge flexibly connected to an edge of the bottom of the bag.

5. The bag of claim 1 wherein the spring has an arch-like shape.

6. The bag of claim 1 wherein the spring is secured to an inner one of two layers of fabric the spring lies between.

7. The bag of claim 6 wherein the spring is secured to the layer of fabric by sewing.

8. A fabric bag having attached straps for hand or shoulder carriage of the bag, comprising:

a. a collapsible canopy for concealing a baby during diaper change, the canopy having one end secured to the bag, the canopy when collapsed being storable within a pocket portion of the bag, the canopy comprising:

i. a changing pad for supporting a baby during diaper changeover;

ii. an elastic fabric tunnel for overlying the changing pad during diaper changing; and iii. a collapsible spring for maintaining the tunnel in position above the changing pad during baby diaper changeover;

b. a pocket formed within the bag, for receipt of the changing pad during diaper changeover, c. the bag having a cover for overlying the canopy when collapsed;

d. a closure for connecting an edge of the cover with the fabric of the bag;

e. a hoop at an end of the canopy remote from the bag, the hoop having an upright portion for maintaining, cooperatively the spring, with the elastic fabric tunnel in position above the changing pad during baby diaper changeover configuration and a base portion defining width of the tunnel; and f. a clip for removably fastening the fabric portion to the hoop.

9. The bag of claim 8 wherein the tunnel further comprises plural layers of fabric overlying one another and the spring lies between two of the fabric layers.

10. The bag of claim 8 wherein the spring is a spiral spring.

11. The bag of claim 8 wherein the changing pad is waterproof.

12. The bag of claim 8 wherein the changing pad is urine-impermeable.

13. The bag of claim 12 wherein the bag has a flat bottom and the cover has a straight edge adjoining the bottom of the bag.

14. The bag of claim 12 wherein the flap has a curved edge releasably connecting with a remainder portion of the bag to close the pocket portion of the bag when the flap curved edge is connected to the remainder portion of the bag.

15. The bag of claim 14 wherein the curved edge of the flap defines a curved portion of the pocket having the same curvature as the tunnel of the canopy.

* * * * *